United States Patent [19]

Chiasson

[11] Patent Number: 4,712,259

[45] Date of Patent: Dec. 15, 1987

[54] INFLATABLE TRAVEL PILLOW WITH CASE

[76] Inventor: Moise Chiasson, 5326A Pierre Tétreault, Montreal, Quebec, Canada, H1K 2Y9

[21] Appl. No.: 35,923

[22] Filed: Apr. 8, 1987

[30] Foreign Application Priority Data

Apr. 15, 1986 [CA] Canada ..... 506745

[51] Int. Cl.[4] ..... A47G 9/00

[52] U.S. Cl. ..... 5/441; 5/490

[58] Field of Search ..... 5/441, 490, 485, 434, 5/436, 449

[56] References Cited

U.S. PATENT DOCUMENTS

D. 273,166 3/1984 Koves ..... 5/441
3,204,678 9/1965 Worcester ..... 5/441
3,340,969 9/1967 Rothberg ..... 5/441
4,590,633 5/1986 Pickens ..... 5/485

FOREIGN PATENT DOCUMENTS 1061480 8/1979 Canada ..... 5/490

*Primary Examiner*—Alexander Grosz
*Attorney, Agent, or Firm*—Samuel Meerkreebs

[57] ABSTRACT

A travel pillow has a first pneumatic pillow base or enclosure adapted to fit within a pillowcase. The pillowcase has an invertable pocket formed in one wall thereof with a slide fastener closing the opening in the wall. The invertable pocket is such as to allow the pillowcase to be stuffed therein and the deflated pneumatic enclosure to be folded and stowed within the so-formed envelope. The slide fastener can then be closed containing both the pneumatic enclosure and the pillowcase.

3 Claims, 5 Drawing Figures

10
18

14
16
12
3
3

14
16
10

14a
24
14b
16
12b
12
10
12a
12

22
12b
12a
14a
24
12
14b
10
18
22
16
16
22
20

INFLATABLE TRAVEL PILLOW WITH CASE

BACKGROUND OF THE INVENTION

1. Field of the Invention

The present invention relates to travel pillows, and more particularly, to travel pillows with a combined case which can be used as a carrying case.

2. Description of the Prior Art

Travel pillows are known which include an inflatable pillow, a pillow case, and a separate carrying case for transporting the deflated pillow and case when not in use. An example of such a device is illustrated in Canadian Patent No. 1,061,480, issued Aug. 28, 1979 to Florence Seaman. The travel pillow described in this Canadian patent includes an inflatable pillow with an intermediate case having a fiberfill construction and a separate carrying case with a handle which can also serve as a slipcover on the pillow. Quite apart from the slipcover carrying case, a separate, more compact cover with a handle is also provided for carrying the other elements when rolled up and the pillow is deflated. Thus, a maximum of four elements are suggested.

SUMMARY OF THE INVENTION

It is an aim of the present invention to provide an improved travel pillow which has fewer parts and is simpler in construction than that suggested in the prior art.

A construction in accordance with the present invention comprises a portable pillow including an inflatable pneumatic enclosure, a slipcover adapted to receive and contain the pneumatic enclosure when inflated and a wall of the slipcover comprising an opening formed with a closure and an envelope surrounding the opening. The envelope has a size suitable to receive the remainder of the slipcover when the envelope is reversed through the opening and the slipcover is stuffed into the opening and the deflated pneumatic enclosure.

In a more specific embodiment, the closure is in the form of a slide fastener adapted to completely close the opening. The slide or zipper fastener is attached to the edges of the opening formed in the wall of the case, and the envelope is attached to one side of the wall surrounding the zipper such that when the envelope is reversed through the opening, the whole case can then be stuffed into the envelope while exposing the zipper fastener and permitting operation thereof.

Thus, the travel pillow of the present invention can be of simple construction and can be compactly stowed away when not in use. When the deflated pneumatic enclosure is folded and stored in the envelope along with the stuffed pillowcase, the resulting package is no greater than a makeup kit or pipe tobacco pouch which can then be easily stowed in one's overcoat pocket or in one's luggage or purse. In view of the construction as described above, only two elements are required as opposed to the many pieces required in similar prior art constructions.

BRIEF DESCRIPTION OF THE DRAWINGS

Having thus generally described the nature of the invention, reference will now be made to the accompanying drawings, showing by way of illustration, a preferred embodiment thereof, and in which.

DESCRIPTION OF THE PREFERRED EMBODIMENTS

Figures 1, 2, 3, 4, 5:
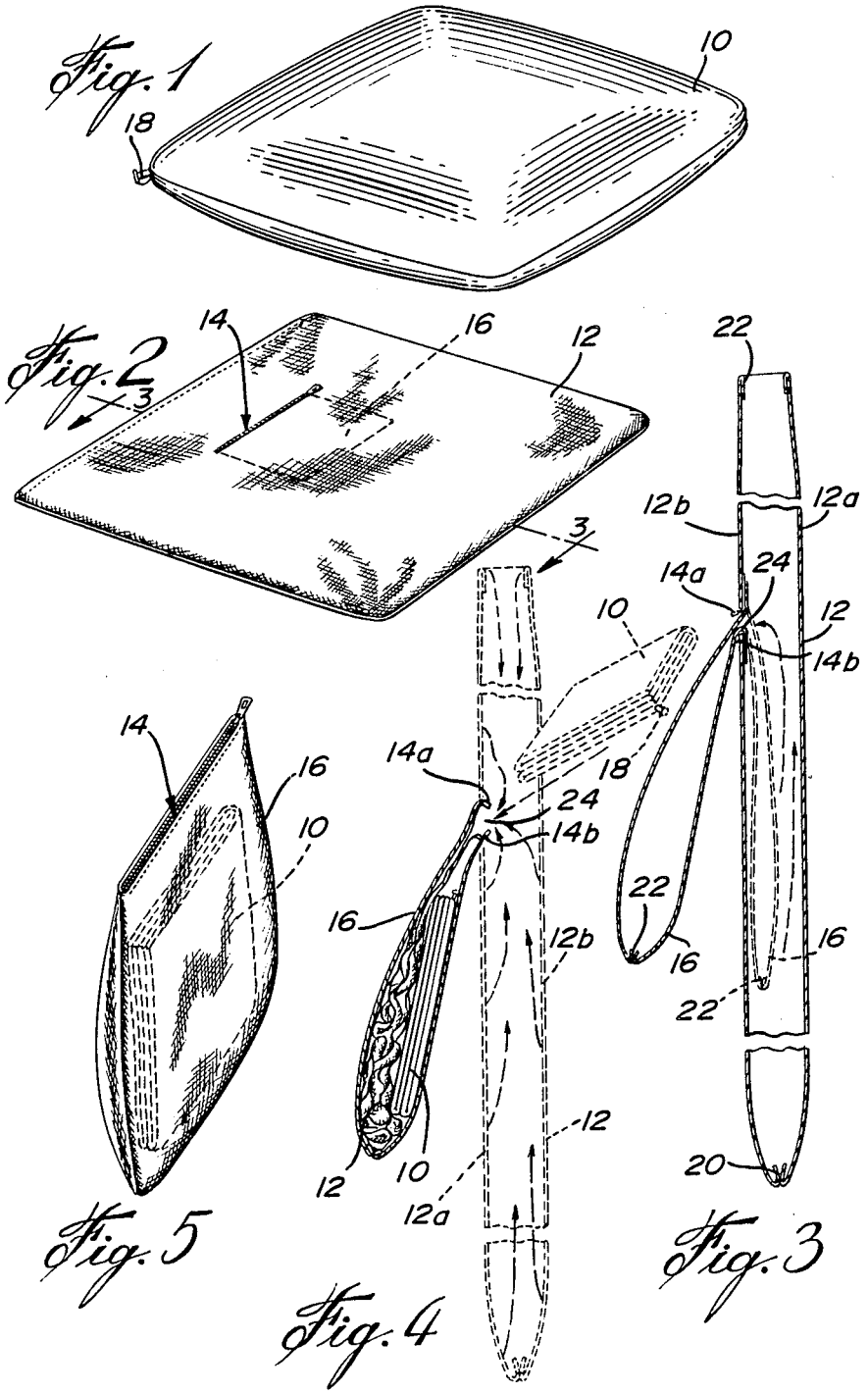
FIG. 1 is a perspective view of the inflatable enclosure forming the base of the pillow of the present invention.
FIG. 2 is a perspective view of the pillowcase in accordance with the present invention.
FIG. 3 is a vertical cross-section taken along line 3—3 of FIG. 2 with one of the details of the pillowcase in a different operative position.
FIG. 4 is a view similar to FIG. 3 with the various elements in a stored position.
FIG. 5 is a perspective view of the package formed when the elements of the travel pillow are in a stored position.

Referring now to the drawings, the inflatable pneumatic enclosure 10 is illustrated in FIG. 1, while the pillowcase 12 is shown separate from the inflatable enclosure 10 in FIG. 2. The pillowcase 12 includes the envelope 16 which forms the carrying pack when the travel pillow is not being used.

The base of the travel pillow is, of course, the inflatable pneumatic enclosure 10 which is provided with a valve 18 of the conventional type. The enclosure 10 can be inflated by mouth, or a hand pump can be utilized to blow it up. However, it is considered that the enclosure will normally be inflated by the mouth. The material forming the enclosure 10 is a rubber-like material, such as rubber, vinyl, or other plastics. It can be formed in various shapes, although a square outline is illustrated in FIG. 1. The sizes can also vary, but a practical size would be a square of 12½ inch sides.

The pillowcase 12 has an opened end 22 and side walls **12*a* and 12*b* which are sewn together along seam 20 on three sides of the pillowcase. The pillowcase 12 would normally be open at one end as shown at 22**.

The pillowcase 12 can have a square outline having sides of 14 inches which will comfortably receive the pneumatic enclosure 10. The material of the pillowcase 12 may be a polyester and cotton fabric. The fabric is chosen such that it is breathable and presents a soft surface.

On the wall **12*b*, an opening 24 is defined by a pair of parallel edges to which slide fastener or zipper 14 is attached. The zipper 14 includes chains of teeth 14*a* and 14*b* sewn to respective edges of the opening. The zipper 14 normally faces on the outside of wall 12*b*, as shown in FIG. 2. A fabric envelope 16 is provided on the interior of the pillowcase and is sewn to the wall 12*b* around the opening 24, that is, around the zipper chains 14*a* and 14*b*. In this situation, the envelope 16 can serve as a pocket for storage. The envelope 16 is fabricated such that the seam 22 is exposed when the envelope is in its normal position on the interior of the pillowcase. However, when it is required to stow the travel pillow, the fastener 14 is opened and the envelope 16 is inverted through the opening 24, such as shown in FIG. 3, so that the seam 22 is on the interior thereof. As shown in FIG. 3, the zipper chains 14*a* and 14*b* are exposed to the outside of the pillowcase 12 on either side of the envelope 16 which has been inverted. The remainder of the pillowcase can now be stuffed into the envelope 16 and assume the position of FIG. 4 showing the zipper chains 14*a* and 14*b* exposed. The pneumatic enclosure 10 is then deflated completely and folded to be stuffed into the envelope 16, as shown in FIG. 4. The slide fastener or zipper 14 is then closed, and the resulting package is as illustrated in FIG. 5**.

I claim:

1. A portable travel pillow comprising the combination of an inflatable pneumatic enclosure, a slipcover adapted to receive and contain the pneumatic enclosure when inflated, a wall of the slipcover comprising an opening formed with a closure and an envelope surrounding the opening, said envelope having dimensions suitable to receive the remainder of the slipcover when the envelope is inverted through the opening and the slipcover stuffed into the opening and the deflated pneumatic enclosure stowed therewithin.

2. A travel pillow as defined in claim 1, wherein the closure is a slide fastener adapted to close the opening and the envelope is attached to the wall of the slipcover surrounding the slide fastener such that when the envelope is inverted through the opening, the slide fastener will be exposed and operable for opening or closing thereof.

3. A travel pillow as defined in claim 1, wherein the pneumatic enclosure is a rubber-like material and the slipcover is a soft fabric material.

* * * * *